United States Patent [19]

Kornaker et al.

[11] Patent Number: 4,884,005

[45] Date of Patent: Nov. 28, 1989

[54] COLOR PICTURE TUBE WITH SUPPORT MEANS FOR SUSPENDING THE MASK

[75] Inventors: Walter Kornaker, Ulm; Horst Ruopp, Deizisau, both of Fed. Rep. of Germany

[73] Assignee: Nokia Graetz, Pforzheim, Fed. Rep. of Germany

[21] Appl. No.: 208,870

[22] Filed: Jun. 15, 1988

Related U.S. Application Data

[63] Continuation of Ser. No. 17,557, Feb. 24, 1987, abandoned.

[30] Foreign Application Priority Data

Feb. 28, 1986 [DE] Fed. Rep. of Germany ..... 3606469

[51] Int. Cl.[4] ..... H01J 29/07

[52] U.S. Cl. ..... 313/404; 313/405; 313/406; 313/407

[58] Field of Search ..... 313/402, 404, 405, 406, 313/407

[56] References Cited

U.S. PATENT DOCUMENTS

| | | | |
|---|---|---|---|
| 3,912,963 | 10/1975 | Sedivy | 313/402 |
| 4,300,071 | 11/1981 | Dougherty et al. | 313/404 X |
| 4,315,189 | 2/1982 | Goto et al. | 313/405 |
| 4,317,064 | 2/1982 | Dougherty | 313/406 |
| 4,387,321 | 6/1983 | Gijrath et al. | 313/406 |
| 4,572,983 | 2/1986 | Ragland, Jr. | 313/405 |
| 4,644,222 | 2/1987 | Brunn | 313/406 |

FOREIGN PATENT DOCUMENTS 57-152646 12/1982 Japan .

*Primary Examiner*—Donald J. Yusko
*Assistant Examiner*—Michael Horabik
*Attorney, Agent, or Firm*—Peter C. Van Der Sluys

[57] ABSTRACT

The shadow mask (2) of a color picture tube has retaining springs (6) near its corners and parallel to its rim. The free ends of the retaining springs (6) extend into the corners of the faceplate (1), where they rest on spherical ends (10) of studs (5). The ends of the retaining springs (6) are bent so as to be perpendicular to the longitudinal axes of the studs (5).

5 Claims, 3 Drawing Sheets

COLOR PICTURE TUBE WITH SUPPORT MEANS FOR SUSPENDING THE MASK

This is a continuation of co-pending application Ser. No. 017,557 filed on Feb. 24, 1987 now abandoned.

The invention relates to a color picture tube as set forth in the preamble of claim 1.

DE-OS 33 37 825 discloses such a color picture tube in which the studs for supporting the shadow mask are located approximately at the center of each sidewall of the faceplate. Each stud has a cylindrical base portion and ends in a truncated-cone-shaped tip. Approximately at the center of each side of the frame supporting the shadow mask, retaining springs are provided whose free ends have holes, so that the ends can rest on the truncated-cone-shaped tips. The free end of at least one retaining spring is provided with a spacer which rests with its opening on the tip on the stud, thus ensuring that the arrangement is firmly held in place.

It is the object of the invention to provide a color picture tube having a simple suspension for its shadow mask which permits easy insertion and removal of the shadow mask during the production of the color picture tube and ensures that the shadow mask is safely held on the studs if forces act from outside.

This object is achieved by the means set forth in claim 1. Further advantageous features are set forth in claims 2 to 4.

An embodiment of the invention will now be explained with reference to the accompanying drawings, in which.

FIGS. 4*a* to 4*f* are schematic representations of six other possible locations for the attachment of the retaining springs.

Figure 1:
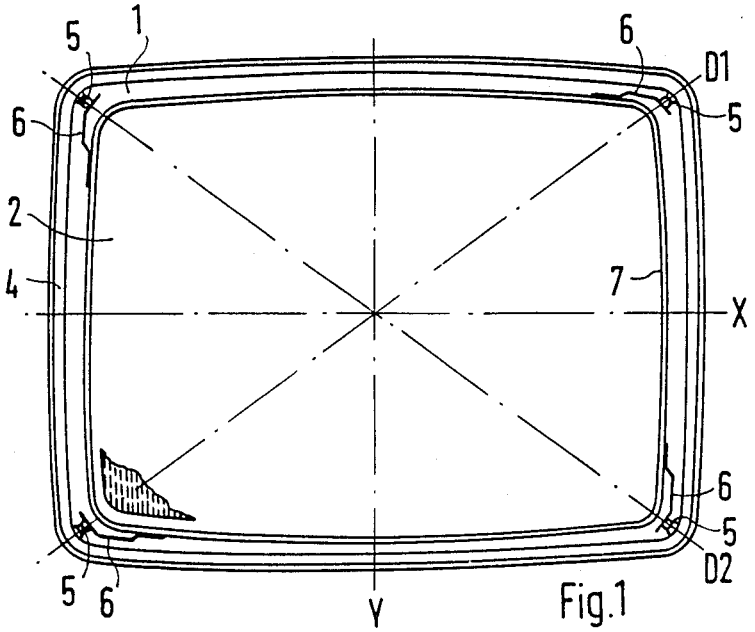
FIG. 1 is a top view of a faceplate with a shadow mask inserted therein.

FIG. 1 shows only the faceplate 1 with the inserted shadow mask 2 of a conventional color picture tube. This representation shows the X axis, the Y axis, and the diagonals D1 and D2. At the point of intersection of the X axis with the Y axis, the axis of symmetry of the color picture tube is perpendicular to the plane of the paper. On its inside, the faceplate 1 carries the phosphor layer (not shown). At the point of intersection of the diagonals D1 and D2 with the sidewalls 4 of the faceplate 1, studs 5 are located which support the shadow mask 2 by way of retaining springs 6. The retaining springs 6 are attached to the rim portion 7 of the shadow mask 2 near its corners with mid portions extending essentially parallel to the rim of the shadow mask.

Figure 2:
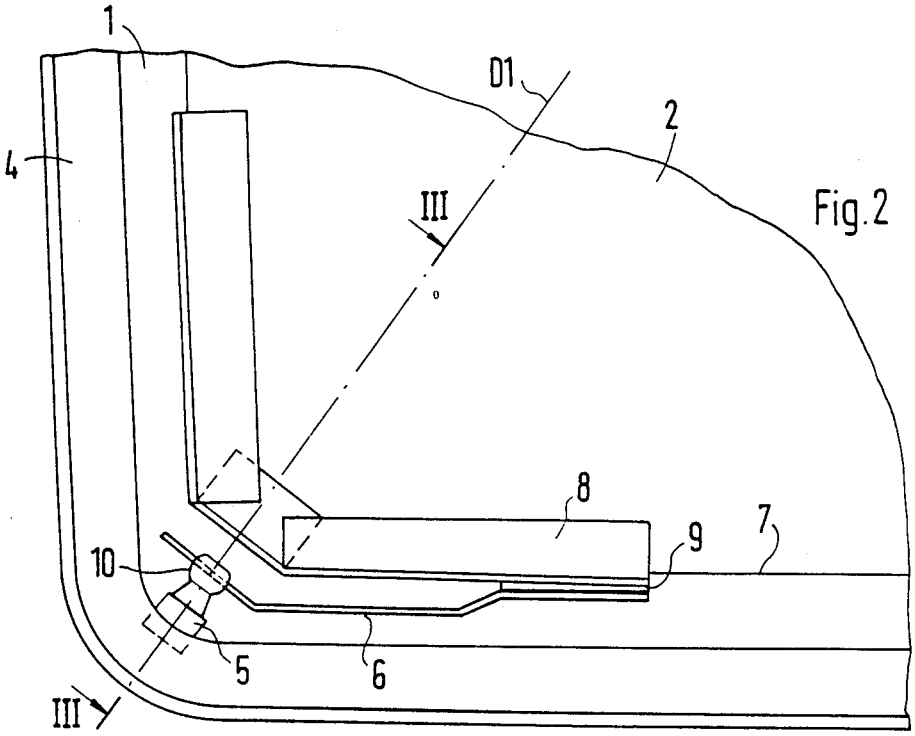
FIG. 2 is a top view of one corner of the faceplate with the shadow mask inserted therein.

FIG. 2 is an enlarged top view of the lower left-hand corner of the faceplate 1. An auxiliary bracket 8 is welded to the rim portion 7 of the shadow mask 2 to reinforce the corner. To the right-hand end of the auxiliary bracket 8, a bimetal element 9 is attached which is welded to one end of the retaining spring 6. The retaining spring 6 is approximately parallel to the rim portion 7 of the shadow mask 2, and its other, free end extends into the corner of the faceplate 1. The stud 5, whose free end 10 is spherical, is recessed into the sidewall 4 at the corner of the faceplate 1. The free end of the retaining spring 6 is bent so that its surface is perpendicular to the longitudinal axis of the stud 5. The longitudinal axis of the stud 5 coincides with the diagonal D1. The free end of the retaining spring 6 has a hole for receiving the spherical end 10 of the stud 5.

Figure 3:
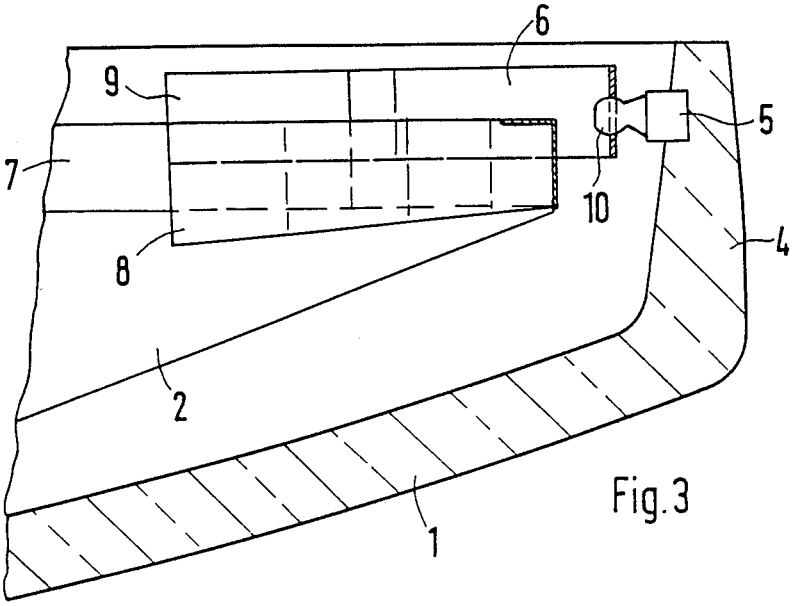
FIG. 3 is a section taken along line III—III of FIG. 2.

FIG. 3 is a section taken along line III—III which coincides with the diagonal D1. This representation shows the small width of the retaining springs 6. The retaining springs 6 can be resilient in two planes, namely tangentially and like a torsion bar. The resulting movements of the retaining springs are made possible by the spherical ends 10 of the studs 5, and there are no forces which would lift the retaining springs off the studs. It is therefore not necessary to secure the retaining springs in position. Thanks to the special design of the studs and the retaining springs, automatic insertion and removal of the shadow mask are possible.

Figure 4A:
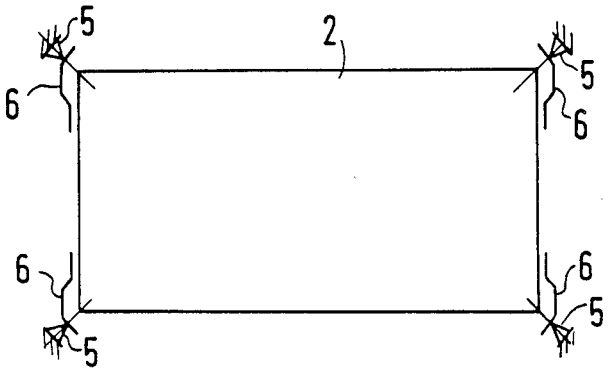
Figure 4B:
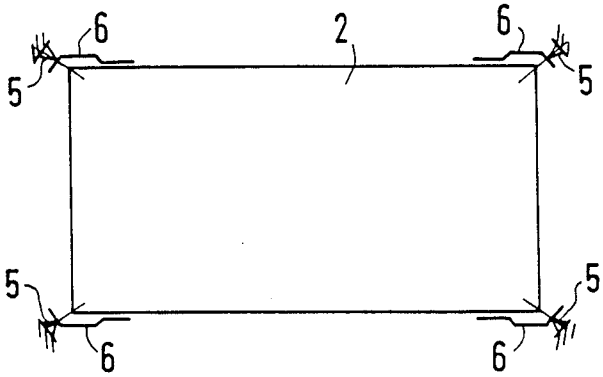
Figure 4C:
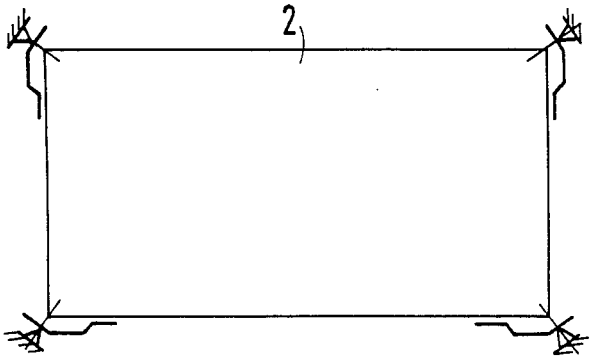
Figure 4D:
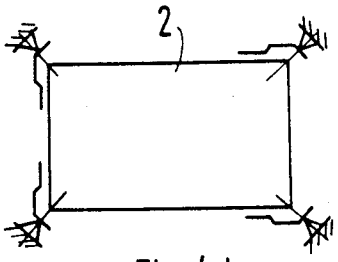

FIGS. 4*a* to 4*f* are schematic representations each showing only the shadow mask 2, the retaining springs 6 and the studs 5. FIG. 4*a* shows two retaining springs 6 each attached to the two opposite short sides of the shadow mask 2. FIG. 4*b* shows that two retaining springs 6 each are attached to the two opposite long sides of the shadow mask 2. In FIG. 4*c*, one retaining spring 6 is located at each short side and two retaining springs 6 are located at the long lower side of the shadow mask 2. In FIG. 4*d*, two retaining springs 6 are provided at the left-hand short side and one retaining spring 6 is provided at each long side of the shadow mask 2.

Figure 4E:
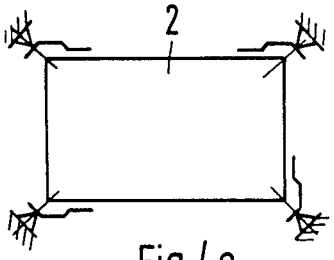
Figure 4F:
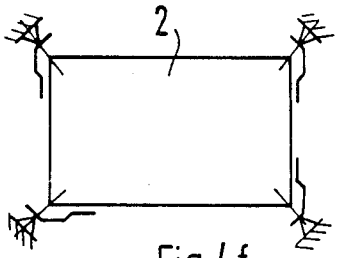

In FIG. 4*e*, it is shown that two retaining springs 6 are present at the upper long side and one retaining spring 6 each is present at the right-hand short side and at the lower long side of the shadow mask 2. The locations of attachment shown in FIG. 4*f* where two retaining springs 6 are located at the right-hand short side and one retaining spring 6 each is located at the left-hand short side and at the lower long side of the shadow mask 2 are also possible.

What is claimed is:

1. A color picture tube, comprising:

a funnel portion;

a neck portion attached to said funnel portion;

a generally rectangular faceplate having sidewalls attached to said funnel portion;

studs having a base portion attached to the inside of the sidewalls of the faceplate at the corners of said rectangular faceplate, said studs extending inwardly and having spherical ends;

a shadow mask disposed within the faceplate, said shadow mask being generally rectangular and having a rim extending about its periphery;

auxiliary brackets mounted to the corners of the rim of the shadow mask; and resilient strip-like retaining springs having first ends attached to said auxiliary brackets and mid portions extending essentially parallel to the rim of the shadow mask to second ends in proximity to said studs, said second ends being bent so as to be perpendicular to longitudinal axes of the studs, said second ends including apertures for receiving a portion of the spherical ends of the studs, whereby the second ends of the strip-like retaining springs are resiliently retained on said studs by the resiliency of the retaining springs so that said shadow mask is retained within said faceplate.

2. A color picture tube as described in claim 1, additionally comprising bimetallic elements attached between said auxiliary brackets and said retaining springs.

3. A color picture tube as described in claim 2, wherein said rectangularly shaped shadow mask has two short sides and two long sides, two of said retaining springs being disposed at each short side of the shadow mask.

4. A color picture tube as described in claim 2, wherein said rectangular shadow mask has two long sides and two short sides, two of said retaining springs being disposed at each of said long sides of the shadow mask.

5. A color picture tube, comprising:

a funnel portion;

a neck portion attached to said funnel portion;

a generally rectangular faceplate having sidewalls attached to said funnel portion, said faceplate defining diagonals extending across opposite corners of said faceplate;

studs having a base portion attached to the inside of the sidewalls of the faceplate at the corners of said rectangular faceplate where said diagonals intersect said sidewalls, said studs extending inwardly along a longitudinal axis parallel to said diagonals and having ends defined at least in part by a spherical surface;

a shadow mask disposed within the faceplate, said shadow mask being generally rectangular and having a peripheral rim;

auxiliary brackets mounted to the corners of the peripheral rim of the shadow mask; and resilient strip-like retaining springs having a predetermined width and first end portions a part of the width of which is attached to said auxiliary brackets, resilient mid portions extending essentially parallel to the peripheral rim of the shadow mask to second end portions in proximity to said studs, said second end portions being bent so as to be perpendicular to longitudinal axes of the studs, said second end portions including apertures for receiving a portion of the spherical surfaces of the studs, said retaining springs being resilient in directions towards and away from the rim of the shadow mask and torsionally and being permitted to move in said directions due to the spherical surfaces of the studs, whereby the second end portions of the strip-like retaining springs are resiliently held on said studs by the resiliency of the retaining springs.

* * * * *